US005379713A

United States Patent [19]

Fujimura

[11] Patent Number: 5,379,713

[45] Date of Patent: Jan. 10, 1995

[54] STABILIZER

[76] Inventor: Noriaki Fujimura, 24-3, Matsubara 4-chome, Setagaya-ku, Tokyo 156, Japan

[21] Appl. No.: 140,327

[22] Filed: Oct. 22, 1993

[30] Foreign Application Priority Data

Oct. 28, 1992 [JP] Japan ..... 4-329812

[51] Int. Cl.[6] ..... B63B 39/00

[52] U.S. Cl. ..... 114/122; 114/121

[58] Field of Search ..... 114/121, 122, 123, 124, 114/125, 126

[56] References Cited

U.S. PATENT DOCUMENTS

| | | | |
|---|---|---|---|
| 429,804 | 6/1890 | Baldwin | 114/122 |
| 1,339,628 | 5/1920 | Selah | 114/122 |
| 3,389,674 | 6/1968 | Pratt | 114/122 |

*Primary Examiner*—Stephen P. Avila
*Attorney, Agent, or Firm*—Lorusso & Loud

[57] ABSTRACT

A stabilizer for a ship includes a track shifting mechanism, pulleys fixed on the track shifting mechanism, pulleys fixed on the ship and a continuous running body such as belt or chain running in a closed loop at high speed around the pulleys, thereby generating, absorbing or changing an angular moment to suppress the rolling of the ship.

10 Claims, 7 Drawing Sheets

STABILIZER

BACKGROUND OF THE RELATED ART

1. Field of the Invention

This invention relates to apparatus which suppresses or reduces the rolling of ships, etc.

2. Description of the Related Art

The suppression of the rolling of ships is important for the safety, comfort and efficiency of the loading and unloading of the cargos of the ships.

One approach in the past was to have the water tank in the ship absorb the energy of the rolling. The disadvantages of this method are that integration by precise computer control is difficult and cannot generate the optimum moment of force against the rolling, resulting in inefficient suppression. Also the value of the absorbing energy or suppressing moment of force is not large.

Another technology used in the past was to have a stabilizer fin on the outside of the ship, by which an antirolling lift force could be controlled by changing the angle of the fin. The disadvantage of this method is that it cannot be effective during anchoring.

Yet another technology used in the past was a gyroscope in the ship having a high speed rotating flywheel to suppress the rolling by the gyro effect of the gyroscope. The disadvantage of this method is that it provides a moment of force over a short distance, between the supporting points or fulcrums, compared with the size the ship causing structural instability. A large size gyroscope could solve the structural instability but would occupy a large space in the ship.

SUMMARY OF THE INVENTION

It is an object of the present to provide a stabilizer to enable a precise rolling suppression effect, to provide a large value of moment of force or absorbing energy to suppress the rolling, to enable the rolling suppression effect during the anchoring of the ship, to provide structurally stable equipment with a long distance between the supporting points or fulcrums receiving the external moment of force compared with the size of the ship.

In order to meet the above objectives, the apparatus of this invention has a belt or chain, etc. which runs continuously at high speed ("continuous running body" hereinafter) and a mechanism which can change the track of the continuous running body ("track shifting mechanism" hereinafter). The apparatus suppresses the rolling by controlling the track shifting mechanism actively or passively.

The continuous running body has its angular momentum determined by the area formed by its track, running speed and its weight per unit length. This angular momentum can be changed by changing the track of the continuous running body. The differential of the angular momentum is the moment of force. So the moment of force can be generated by shifting or controlling the track shifting mechanism.

Thus, by changing or controlling the track shifting mechanism to the appropriate direction and speed, a moment of force can be generated to counteract or absorb the external moment of force causing the rolling.

The track shifting mechanism may shift passively responsive to the external moment of force. By passive shifting of the track shifting mechanism, a moment of force is generated to counteract the external moment of force and to thereby suppress the rolling.

One advantage of this invention is that the apparatus can generate a moment of force freely by the free format of the control system, thus enabling precise and effective control, and consequently, a high quality antirolling effect.

Another advantage of this invention is that the apparatus can be installed completely inside the ship and does not need the force generated by the running of the ship. It means that the apparatus of this invention is effective during the anchorage of the ship.

Another advantage of this invention is that it enables a wide range of control by the wide area formed by the track of the continuous running body, by the high speed of the continuous running body, and by realizing a large value of angular momentum and moment of force.

Another advantage of this invention is that the height of the apparatus is small and the total apparatus is rather planar. Thus, the apparatus of this invention does not occupy a large volume of space when installed in the ship.

Another advantage of the invention is that the total structure of the apparatus is simple and easily installed in the ship.

Another advantage of this invention is that the apparatus can be applied to Other floating ship-like structures and to ice breaking ships.

DESCRIPTION OF THE PREFERRED EMBODIMENTS

Figure 1:
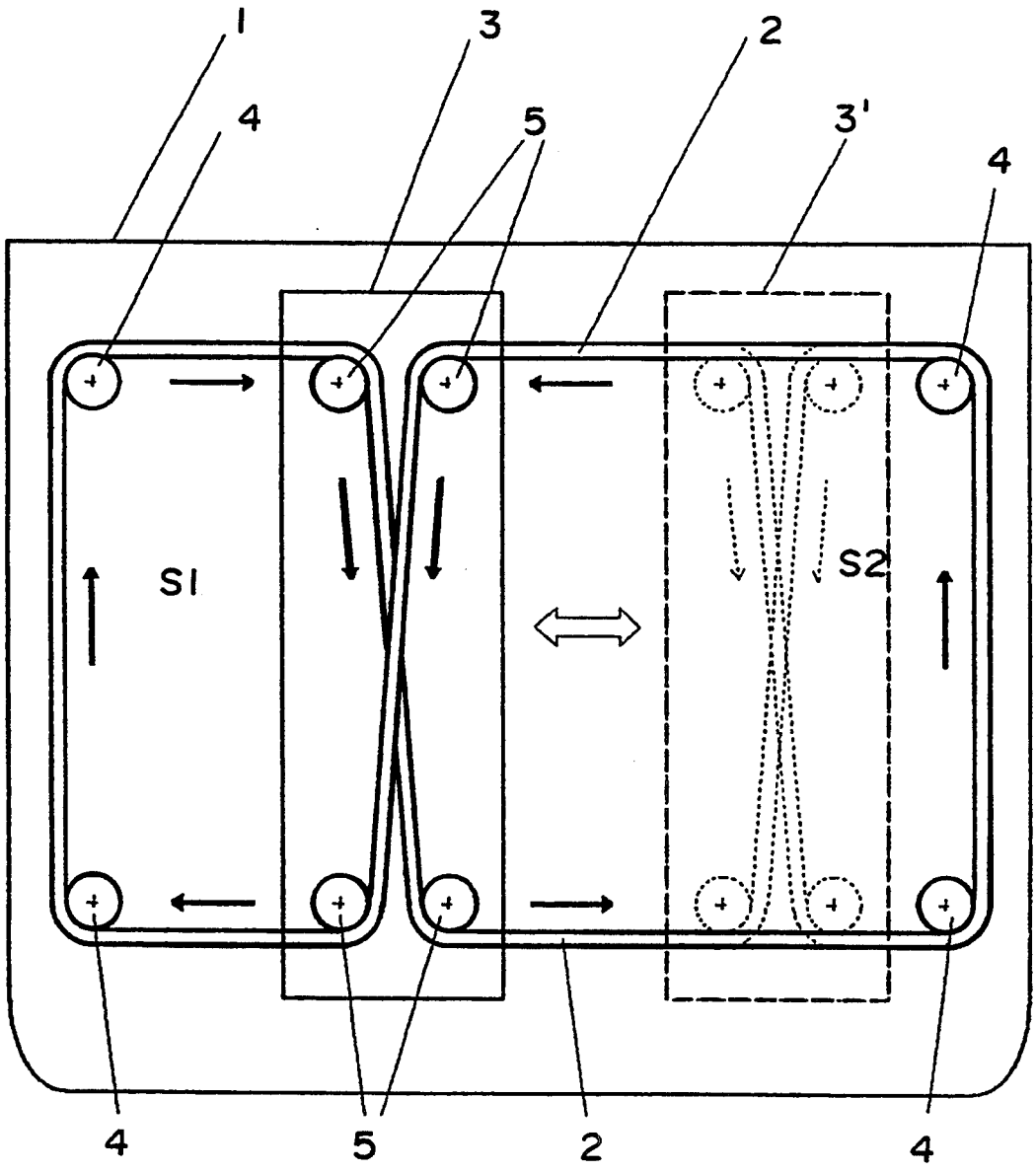
FIG. 1 is a plan view of one embodiment of the invention.

FIG. 1 shows the basic structure of an embodiment of the invention wherein a belt or chain 2 (continuous running body) inside the ship 1 runs at a high speed circulatively along the track defined by the pulleys or gears 4 and 5.

This path can be changed by the track shifting mechanism 3. This track shifting mechanism shifts in parallel horizontally to, for example, the position shown dotted line.

The pulleys or gears consist of fixed pulleys or gears 4 (hereinafter "fixed pulleys") fixed to the ship and movable pulleys or gears 5 (hereafter "movable pulleys") fixed to the track shifting mechanism.

The track of the continuous running body 2 is changed by the shift of the track shifting mechanism 3.

The continuous running body 2 runs circulatively with angular momentum. This continuous running body runs along the track crossing in the way, thereby reversing the direction of rotation. In FIG. 1, the rotation is clockwise running along the track forming the area S1, and counter-clockwise rotation around the area S2.

When the track shifting mechanism shifts right, the area S1 increases and S2 decreases. AS the result, the clockwise angular momentum increases. When the track shifting shifts left, the clockwise angular momentum decreases. The sum total of the absolute values of each angular momentum does not change by shifting of the track shifting mechanism 3 because the sum total of the areas does not change. Also the sum total of the absolute values for changing areas S1 and S2 does not change. This fact means that no specific force is applied to the track shifting mechanism 3 by the steady running motion of the continuous running body 2.

The height or depth, perpendicular to the drawing, of the structure of the embodiment of the apparatus is small, so the basic structure of the embodiment is plan, not occupying a large volume of the ship interior space when installed.

(A) Basic Principle of the Operation

The continuous running body 2 generates angular momentum by its running motion. As shown FIG. 2, the value of the angular momentum is determined by the area $S_1$, $S_2$ formed by the running track, running velocity $V_o$ and mass of the continuous running body 2 per unit length m. Assuming the clockwise angular momentum is positive, the angular momentum $M_o$ is calculated as follows, $$M_o = 2mV_o(S_1 - S_2)$$

The difference between the areas $S_1$ and $S_2$ $(S_1 - S_2)$ can be changed by shift of the track shifting mechanism 3. When it shifts right, $S_1$ increases and $S_2$ decreases. The angular momentum is proportional to the difference between $S_1$ and $S_2$, the angular momentum can be controlled by shifting the track shifting mechanism 3.

The time domain change (differential) of the angular momentum is the moment of force. Thus, a moment of force can be generated by shifting the track shifting mechanism 3.

Taking the velocity of the rack shifting mechanism 3 as $V_c$, the velocity of the continuous running body as $V_o$, the height of the shape forming $S_1$ and $S_2$ as h, the generated moment of force is calculated as follows, $$\begin{aligned} Ie &= \frac{d}{dt} M_0 = \frac{d}{dt} 2mV_0(s_1 - S_2) \\ &= 4mV_0V_ch \end{aligned} \quad (1)$$

Thus, when the track shifting mechanism 3 shifts, a moment of force proportional to its velocity $V_c$ is generated.

This operation is reversible. That is, when the track shifting mechanism shifts, the moment of force is generated and when the moment of force is applied to the track shifting mechanism, the track shifting mechanism shifts.

The shift caused by the external moment of force generates the moment of force resisting the external moment of force. This generation of moment of force can be used to suppress or decrease the rolling.

The above explanation referred to the total change of the angular momentum and generated moment of force. A more detailed description of operation based on the individual generated forces at each point will be given with reference to FIG. 2.

(1) Basic force generated by the change of the track of the continuous running body.

The force F generated by the change of the direction of the continuous running body around the pulleys or gears is the change of the momentum $P_o$ per unit of time caused by the change of the running direction around the pulleys or gears. It is calculated as follows.

$$F = \frac{d}{dt} P_0 = V_dM_d = V_dm\frac{d}{dt} L = mV_d^2 \quad (2)$$

In above equation, $V_d$ is the changed value of the velocity of the continuous running body 2 around the pulleys, L is the length of the continuous running body and m is the mass of the continuous running body per unit length. The value $V_d$ differs at the various points around the fixed and movable pulleys.

For example, when the running of the continuous running body, at speed $V_o$, changes from "horizontal" (as shown in the drawings) to "vertical" (in the drawings) around the pulley, the horizontal speed changes from $V_o$ to zero and the vertical speed changes from zero to $V_o$. The changing absolute value is $V_o$ for each.

(2) The forces created around each of the pulleys.

(a) The forces at fixed pulleys 4 compensate each other because the velocity of the continuous running body around each of the fixed pulleys is the same and the relative positions of the pulleys are fixed. The values $V_d$ shown in the equation (1) for opposing pulleys are the same in absolute value but opposite in direction and thereby cancel each other.

Figure 2:
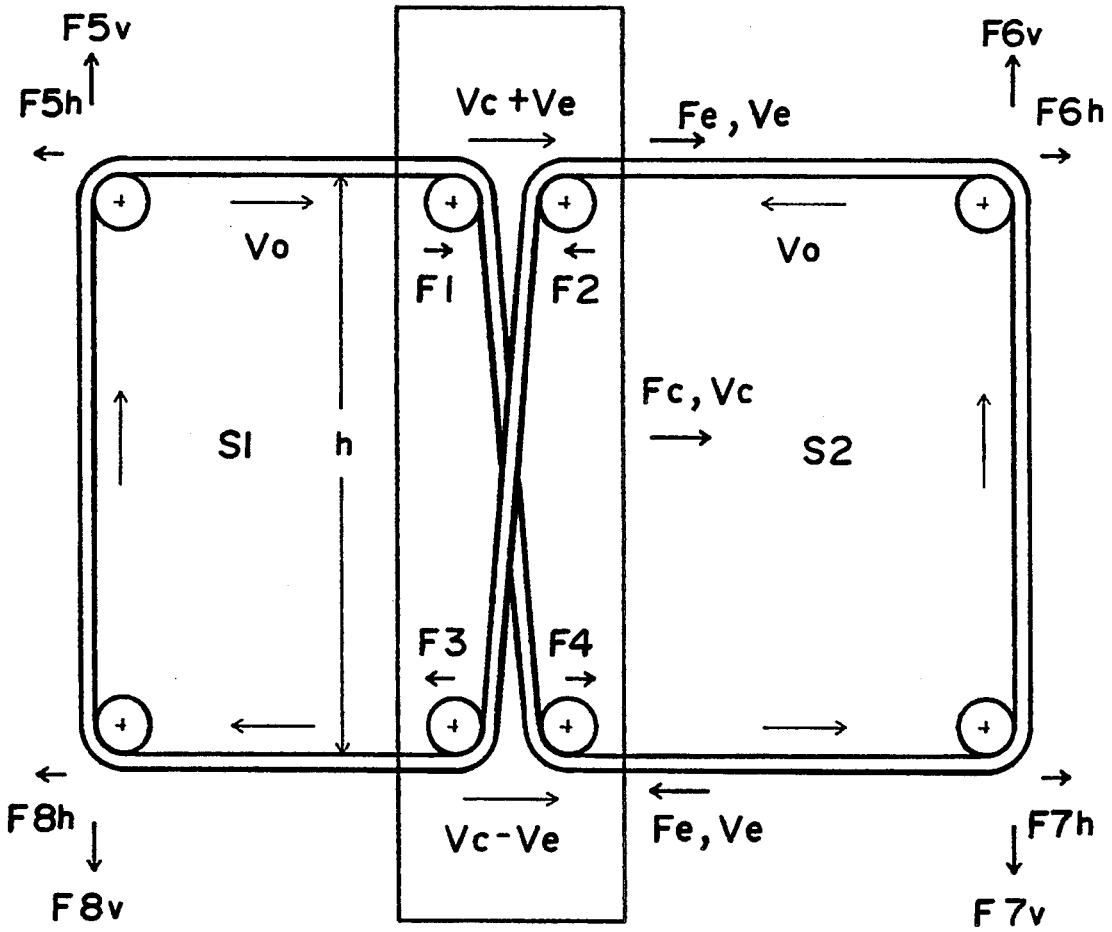
FIG. 2 is a plan view similar to FIG. 1 showing force vectors for explanation.

In FIG. 2, the forces F5h and F6h, F7h and F8h, F5v and F8v, F6v and F7v cancel each other.

So the interactions between internal and external forces or moment of force can be treated as forces existing only around the movable pulleys.

(b) The forces created around each of the movable pulleys

The forces at the movable pulleys are-caused by, (1) the change of the direction of the running of the continuous running body, (2) the shift of the track shifting mechanism and (3) the forces applied by the external rolling or acceleration.

Taking the steady velocity of the continuous running body as $V_o$, the shifting velocity or,the track shifting mechanism as $V_c$, the force applied to the track shifting mechanism as $F_c$, the velocity applied from the exterior to the half height of the track shifting mechanism h (h is the height of the track of the continuous running body, h/2 is the radius of the rotation of the track shifting mechanism) as $V_e$, the force as $F_e$, $F_e$ and $V_e$ come from the rotating movement of the continuous running body and are reverse at opposing positions.

The change of the velocity vectors of the running of the continuous running body around each of the movable pulleys is calculated as follows, $$\begin{aligned} V_{d1} &= (V_0 - V_c - V_e) \\ V_{d2} &= (V_0 + V_c + V_e) \\ V_{d3} &= (V_0 + V_c - V_e) \\ V_{d4} &= (V_0 - V_c + V_e) \end{aligned} \quad (4)$$

The forces at the various points are calculated as follows, $$\begin{aligned} F_1 &= m(V_0 - V_c - V_e)^2 \\ F_1 &= m(V_0 + V_c + V_e)^2 \end{aligned} \quad (5)$$

-continued $$F_1 = m(V_0 + V_c - V_e)^2$$
$$F_1 = m(V_0 - V_c + V_e)^2$$

The relation between the external moment of force and velocity on the track shifting mechanism and the internal shifting velocity and force of the track shifting mechanism itself.

The forces around the movable pulleys are balanced as the total forces summing actions and reactions. That is, the external forces causing rolling, the forces applied to the track shifting mechanism and the force generated by the shifting of the track of the continuous running body are totally balanced. This relationship is calculated for the upper part and lower part of the track shifting mechanism as follows, $$F_e + F_c/2 = F_2 - F_1 = 4mV_0V_c + 4mV_0V_e \quad (6)$$
$$F_e - F_c/2 = F_4 - F_3 = 4mV_0V_c + 4mV_0V_e$$

So the relationships between the $F_e$, $V_e$ and $F_c$, $V_c$ namely the relation between the motion of the track shifting mechanism and the external rolling force $F_e$ is calculated as follows, $$F_e = 4mV_0Vc \quad (7)$$
$$V_e = F_c/8mV_0$$
$$F_e = 8mV_0V_e$$
$$V_c = F_e/4mV_0$$

Converting the $F_e$, $V_e$ to the moment of force and angular velocity, $$I_e = F_e \times h \quad (8)$$
$$W_e - 2V_e/h$$

Applying the equation (7) to equation (8), $$I_e = 4mhV_0V_c \quad (9)$$
$$W_e = F_e/4mV_0h$$
$$F_c = 4mV_0W_eh$$
$$V_c = Ie/4mV_0h$$

This equation indicates the relation between the velocity and force of the track shifting mechanism and the angular velocity and moment of force f of rolling action on the apparatus from the exterior.

The value of $I_e$ of equation (9) coincides with the $I_e$ of equation (2). It means that the moment of force determined by analysis of the total area S1, S2 and the moment of force determined by analysis of the individual forces coincide.

(4) The relation between the motion of the track shifting mechanism and the motion of the rolling.

(Case 1)—$F_c$ is zero

The equation (9) shows that in case of $F_c$ being zero, namely when no damping or braking is applied to the track shifting mechanism, the rolling angular velocity We is zero, the apparatus does not rotate and no rolling occurs.

(Case 2)—$V_c$ is zero

The equation (9) shows that in case of $V_c$ being zero, namely when the track shifting mechanism is at rest, the moment of force Ie is zero, no resisting moment of force against the rolling is generated, and there is no antirolling effect at all.

(Case 3)—$F_c$ and $V_c$ are not zero.

By the equation (9), $$I_eW_e = F_cV_c$$

The equation (10) shows that the external energy per unit time( or differential of the energy) applied to the apparatus is absorbed by the track shifting mechanism as $F_c \times V_c$.

The equation (10) shows also that in the case where $F_c$ is zero (no damping is applied) and $V_c$ is zero (stopping the track shifting mechanism), there is no absorbing of the rolling energy.

In the case that both $V_c$ and $F_e$ are not zero, namely when some damping is applied by the track shifting mechanism so far as the track shifting mechanism does not stop, the energy of the rolling is absorbed by the apparatus thus reducing the rolling.

When the rolling is in resonance, the absorption of the energy may be more effective for the anti-rolling operation than the compensation for the external moment of force, because the absorption of the energy enables the attenuation of the resonance (increase in the damping factor for the oscillation equation). In this case, damping of the shift of the track shifting mechanism is desirable, selecting the optimum parameters.

(B) Control Method

There are basic two control methods, passive control and active control.

Method 1: Passive Control

The passive control utilizes the natural operation in which the track shifting mechanism shifts by itself responsive to the external moment of force which causes the rolling.

As mentioned before, a moment of force can be generated by shifting of the track shifting mechanism. This operation is reversible, i.e. when an external moment of force is applied to the apparatus, there will be a shift of the track shifting mechanism. By shifting of the track shifting mechanism, a moment of force will be generated as a reaction to the external moment of force causing the rolling.

This passive control operation is similar to the operation of the conventional gyroscope having the high speed rotating wheel which changes the rotating axis responding to and resisting the external moment of force. But the structure of the apparatus of this invention is different and occupies little space when installed.

The passive control basically utilizes the natural (passive) operation of the track shifting mechanism, but there are some cases in which some damping of the shift of the track shifting mechanism is desirable in order to absorb the energy of the rolling and to avoid overstressing the apparatus.

In the passive control, the track shifting mechanism is desirably located at the center of the range of the movement when there is no external moment of force.

In order to realize the above two purposes, to apply the damping to the track shifting mechanism and to enable the central location of the track shifting mechanism, methods are implemented utilizing spring and/or frictional force.

More optimum passive control can be realized by implementing idling, damping and/or directional damping to the movement of the track shifting mechanism depending on its location.

An electric motor can be utilized to position the track shifting mechanism.

This electric motor can also be used as an electric generator, converting the rolling energy into an electric output. This output can be used as some part or all of the energy for the running motion of the continuous running body.

Furthermore this electric motor can be used both as a motor for moving the track shifting mechanism and as a generator for utilizing the rolling energy.

Method 2: Active Control

The active control senses the position (angle), angular velocity and/or angular acceleration (moment of force) of the rolling, processes the output of the sensor, and controls the location or velocity of the track shifting mechanism according to the output of the processor.

Figure 3:
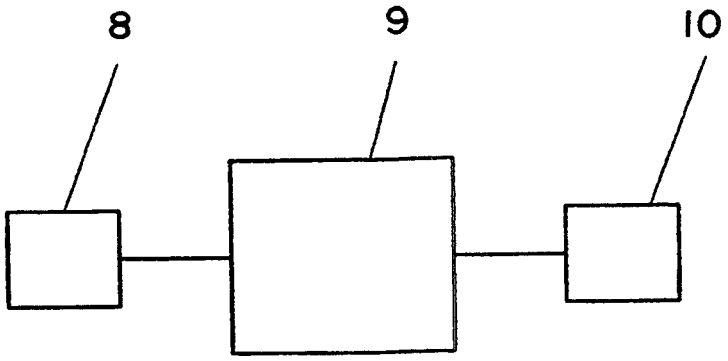
FIG. 3 is a block diagram of a controller for a track shifting mechanism.

An embodiment of an active control system is illustrated by the block diagram shown in FIG. 3. The input to the control system is the output of a sensor 8. This sensor 8 detects the angle, angular velocity and/or angular acceleration of the rolling. If it senses the angle, the angular velocity and the angular acceleration be obtained by differentiating the angle. If it senses the angular acceleration, the angular velocity and angle can be obtained by integrating the angular acceleration. According to the accuracy of the sensor, the system may utilize plural outputs.

The sensor output is led to the signal processor 9. This processor can utilize an analog circuit or a digital computer.

In the case of analog implementation, the processor is combined with an amplifier, differentiator and/or integrator. The input signal is processed by combination of those elements to realize the optimum control system. The analog control can utilize the well established DPI (Differential, Proportional, Integration) control method.

In case of digital implementation, the analog output of the sensor is converted to a digital signal and fed to a digital signal processor such as a digital computer. The processing here is either DPI control, same as analog, or a specific computer control such as fuzzy control.

The output of the signal processor 9 drives the servo motor 10 which shifts the track shifting mechanism.

The electric operation of sensor 8, signal processor 9 and servo motor 10 forms the total control system combined with the mechanical operation of the track shifting mechanism.

(C) Embodiment of the Track Shifting Mechanism

Figure 4:
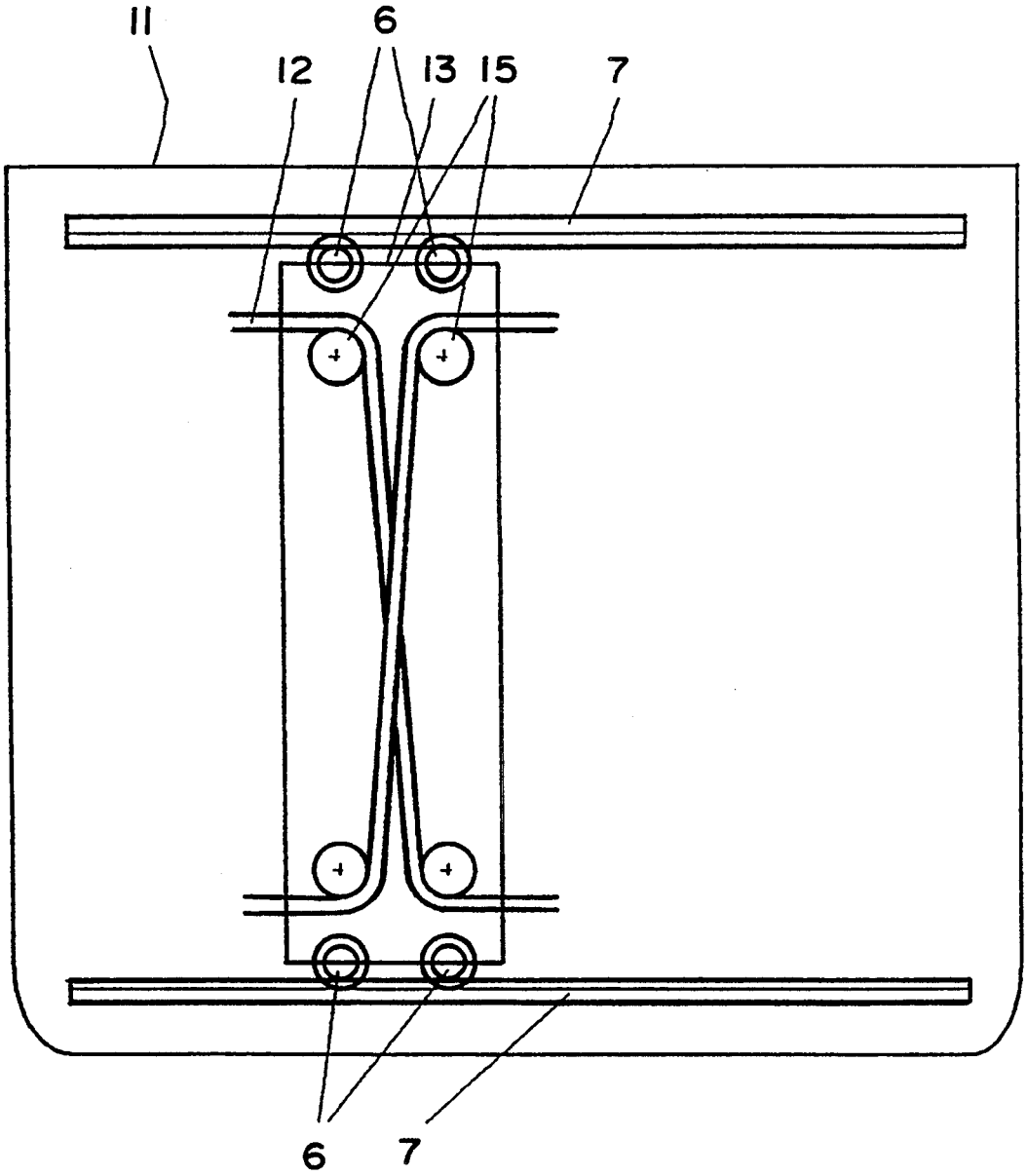
FIG. 4 is a partial plan view of an embodiment of the track shifting mechanism.

An embodiment of the track shifting mechanism is shown in FIG. 4. The track shifting mechanism in FIG. 1 shifts in parallel horizontally. In order to realize this motion, the structure of the track shifting mechanism 3 in FIG. 4 has upper and lower gears 6 running along the upper and lower geared rail 7. Each of the gears 6 is linked by the belt or chain and thereby rotate synchronously with the other gears. The track shifting mechanism 3 shifts in parallel.

In the case of active control, the gears 6 are driven by the servo motor. In the case of passive control, the gears don't need to be driven by the servo motor but the stable positioning of the track shifting mechanism can be realized by operation of the servo motor.

Another Embodiment

Figure 5:
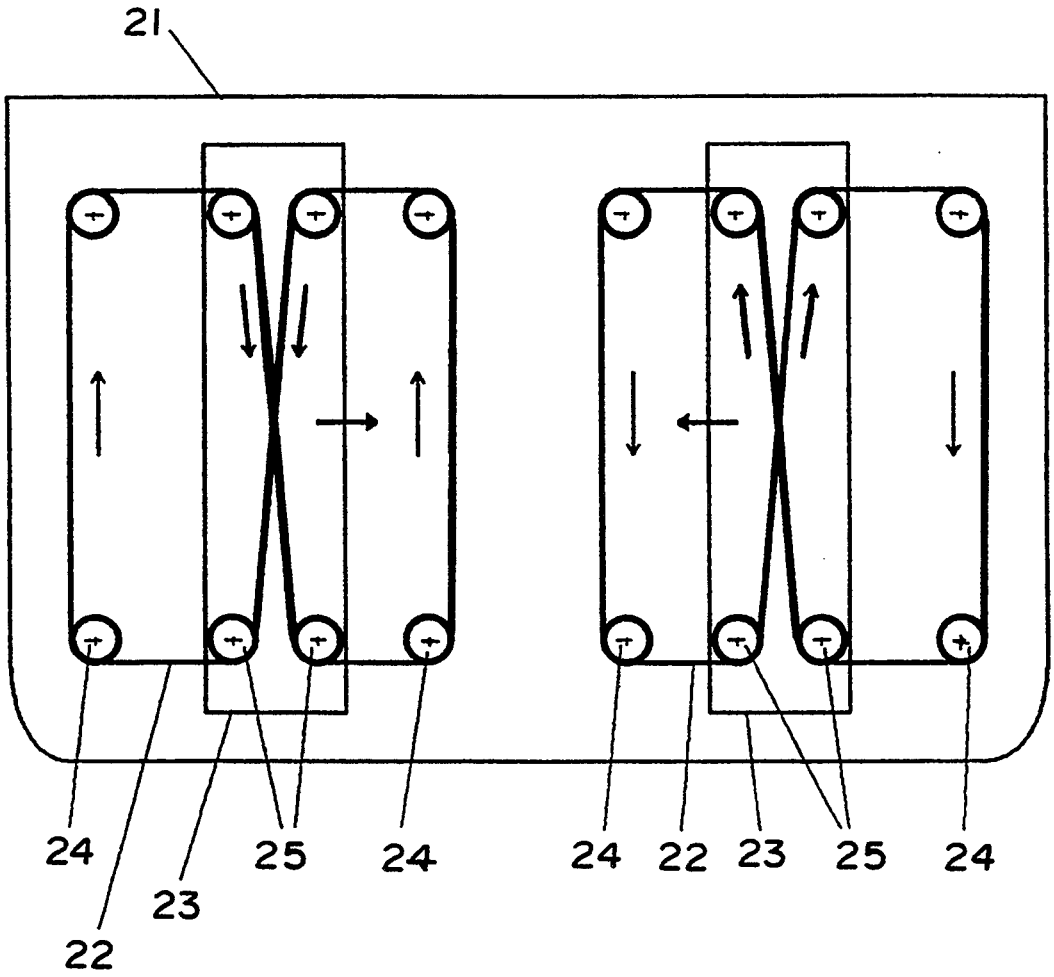
FIG. 5 is a plan view of another embodiment of the invention.

Another embodiment of the track shifting mechanism is shown in FIG. 5. In this embodiment, two symmetrical stabilizers according to this invention are utilized. The running direction of the continuous running body and the track shifting mechanism are opposite. The advantages of this structure are that the weight can be kept balanced while shifting the track shifting mechanism, that there is the room between the two stabilizers which provides space for the crossover or structural construction and that separation by the equipment can be avoided.

The embodiment shown in FIG. 1 and FIG. 5 can be effective against rolling. If the direction of the installation is changed, it can be effective against pitching.

(D) Reducing the Tension on the Continuous Running Body

In the above embodiments, the force generated by a change in the running direction of the continuous running body is applied to the continuous running body as tension. When the speed of the continuous running body is high, the value of tension increases and the apparatus could become unstable.

Figure 6:
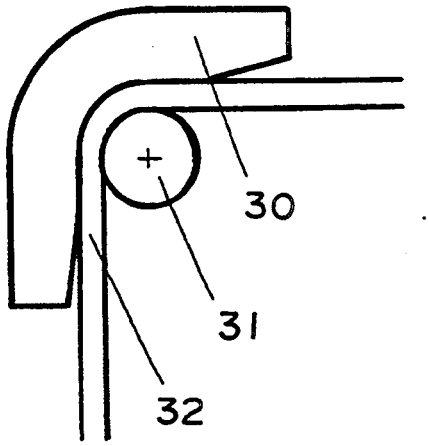
FIG. 6 is a partial plan view of a direction changing mechanism for the continuous running body.

The structure which avoids this mechanical instability is shown in FIG. 6. The guide 30 makes the running direction change of the continuous running body. The tension caused by the change of the running direction is sustained by this guide and not applied to the continuous running body.

Figure 7:
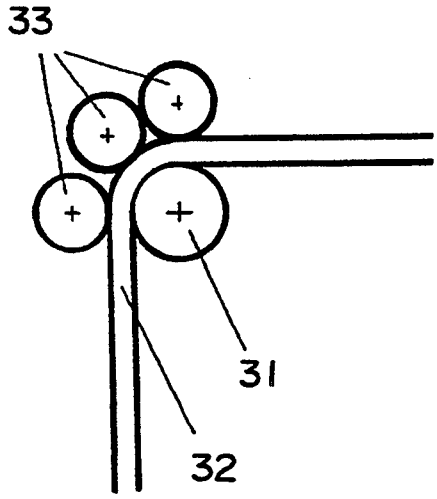
FIG. 7 is a partial plan view of another direction changing mechanism for the continuous running body.

Another embodiment of structure for reducing the tension on the continuous running body is shown in FIG. 7. The pulley 33 for changing the running direction absorbs the tension generated by the change of the running direction of the continuous running body. The tension is not applied to the continuous running body.

Figure 8:
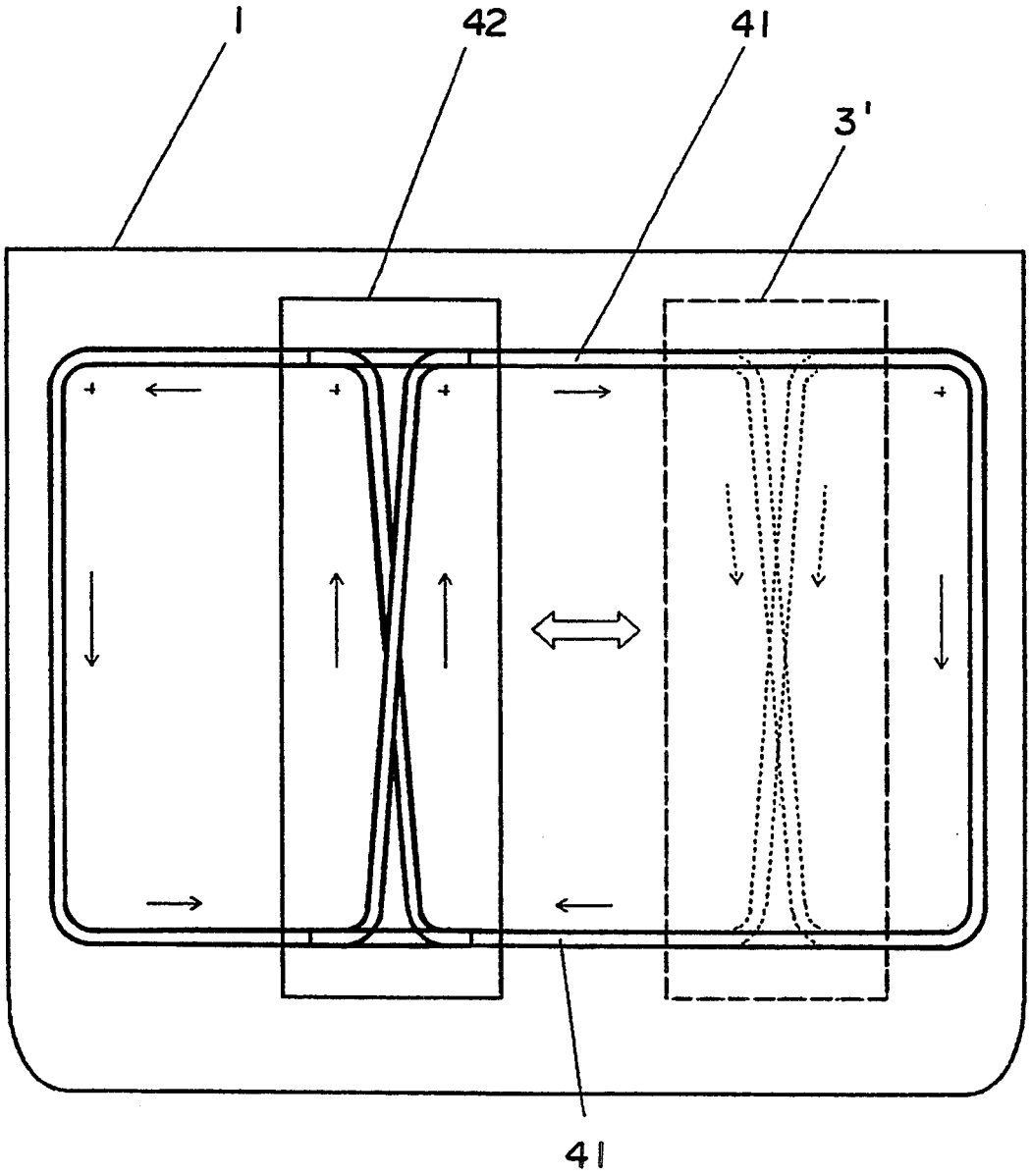
FIG. 8 is a plan view of an embodiment of the present invention including a guide rail.

Yet another embodiment of structure for reducing the tension on the continuous running body is shown in FIG. 8. The continuous running body runs along the guide rail 41. The track formed by the guide rail can be changed by a shift of the track shifting mechanism 42. The tension caused by the change of the running direction is applied only to the guide rail, not to the continuous running body. The guide rail is fixed to the hull and the track shifting mechanism, can sustain a large tension and can reduce the tension applied to the continuous running body.

In the embodiment shown in FIG. 8, the tension applied to the continuous running body is reduced or disappears. The continuous running body does not need to be a continuous linked body but can be formed of discrete or separated bodies. Those discrete bodies run along the same track formed by the guide rail. So this is also referred to as a continuous running body in this description.

In order to reduce the loss of energy during the running of the continuous running body, a wheel or bearing attached to the continuous running body may be effective.

(E) Protection Against Vibration or Noise

The high speed running of the continuous running body may cause vibration or noise. Vibration and noise may be avoided by sealing the continuous running body and fixation to the ship via cushioning materials.

(F) Reducing Energy Consumption

The energy consumption of the running of the continuous running body caused by air resistance can be reduced by the removal of air from the above-mentioned sealed structure.

(G) Application to an Ice Breaking Ship

In the case of active control, the track shifting mechanism can be shifted independent of the rolling generating the moment of force applied from outside the apparatus. So this apparatus can be applied to an ice breaking ship for generating the moment of force necessary for the ice breaking operation. The anti-rolling stabilizer of this invention can be applied, not only to a ship, but also to general land and marine transporting machines or structures which need the anti-rolling function.

(H) Computation of Angular Momentum

By increasing the running speed of the continuous running body, the apparatus can generate a large moment of force or absorb a large amount of the rolling energy. A concrete example of a value for such capacity follows below, (1) Assumed numerical value The numerical values of the parameters of the apparatus and ship are to be as follows,

| | |
|---|---|
| Apparatus: | |
| weight of the continuous running body (5% of the ship weight) | 100 t |
| Controllable area | 10 m × 20 m |
| Running speed of the continuous running body | 40 m/s |
| Ship: | |
| Weight | 5,000 t |
| Effective radius | 10 m |
| Angular speed of the rolling | 0.1 rad/s |

(2) Comparison of the angular momentum between the ship rolling and the apparatus The controllable angular momentum of the apparatus $M_c$ is calculated as follows, $$M_c = 4m_aV_0S$$
$$= 4 \times (1.67 \times 10_3) \times (40) \times (20 \times 10) = 5.3 \times 10_7 \text{ kg m}_2/\text{s}$$

Taking $m_a$ as the weight of the continuous running body per unit length, $m_a$ is calculated as follows.

$$M_a = 1 \times 10_5/2(10+20)\ kg/m = 1.67 \times 10_3\ kg/m$$

(3) The angular momentum of the ship due to rolling

Taking $M_a$ as the angular momentum, M is calculated as follows, $$M_a = M_b \times R_b \times V_b$$
$$= (5 \times 10_6) \times (10) \times (0.1 \times 10) = 5 \times 10_7 \text{ kg m}_2/\text{s}$$

In this equation, $M_b$ is the weight of the ship, $R_b$ is the effective radius of the rolling of the ship, $V_d$ is the rotating speed at the effective radius.

(4) Comparison of the angular momentum of the ship with that of the stabilizer apparatus In this example the numerical values of the angular momentum of the ship rolling $M_a$ and the controllable angular momentum of the equipment $M_c$ are roughly equal. This means that the apparatus can counteract the rolling of the ship by roughly same amount of angular momentum. This also means that the apparatus can suppress the rolling almost completely by using the control method described hereinafter.

The comparison of the angular momentum of the rolling of ship and that of the apparatus is also explained as follows, The angular momentum of the rolling of the ship $M_c$ is shown as follows, $$M_s = M_b \times R_b \times V_b$$

Taking the $R_a$ as the effective rotating radius, $M_a$ as the weight of the continuous running body, $M_a$ and S are calculated as follows, $$M_a = 2\pi R_a x m_a$$

$$S = \pi R_a^2$$

So the controllable angular momentum $M_c$ is calculated as follows, $$M_c = 4m_aV_0S$$
$$= 2M_a \times R_a \times V_0$$

Assuming $R_a$ is equal to $R_c$, the ratio of $M_c$ to $M_b$ is, $M_c:M_b = 2X(M_a33\ V_o):M_b \times V_b$ This equation shows that, assuming the effective rolling radius $R_a$ is equal to the effective radius of the apparatus $R_c$ which is the equivalent radius when the area formed by the track of the continuous running body is reformed into a circle, the ratio of the control able angular momentum to that of the rolling of the ship is equal to the double the value of the multiple of the rotating speed and the weight.

If the speed of the continuous running body is 50 times higher and the weight is 100 times lighter than the rolling of the ship, the angular momentums are same.

In practice, control may consume the rolling energy by increasing the damping factor of the oscillation rather than by direct compensation for the external moment of force. In this case the apparatus does not require sufficient controlable angular momentum to compensate for the rolling at once. So the weight of the continuous running body or running speed can be less.

(5) Value of the absorbed rolling energy

The energy of the rolling absorbed by the apparatus during the half cycle of the rolling is shown as follows (refer to equation 9), taking d as the shiftable distance of the track shifting mechanism.

To estimate a very rough value for this absorbed energy, it is assumed that the external moment of force is constant during the half cycle operation (the operation of the track shifting mechanism in shifting from one end to the other end). The amount of energy is calculated as follows, $$E = F_c \times d = 4mV_0W_eh \times d = 4mV_0SW_e$$
$$= 4 \times (1.67 \times 10^3)(40) \times (20 \times 10) \times (0.1)$$
$$= 5.3 \times 10^6 \text{ kg m}^2/\text{S}^2$$
$$G = 9.8 \text{ m/s}^2$$

This numerical value is equal to the energy required to lift a 54 ton body 10 meters. It means that this apparatus can absorb the rolling energy to a far greater extent than an anti-rolling tank, which absorbs the rolling energy by the movement of the water stored in the tank. Also this apparatus enables more precise control than does the anti-rolling tank.

When the rolling increases, $W_e$ of the above equation becomes larger and the apparatus can absorb more energy.

(6) External force applied to the apparatus

When this apparatus is applied to an ice breaking ship and a need arises to generate a moment of force on structure external to the equipment, the angular moment is actively controlled by shifting the track shifting mechanism. The controlled angular momentum is the integral of the moment of force transferred to the exterior. Assuming the moment of force $I_c$ as constant and taking T as the duration time, $I_c$ is calculated as follows, $$I_c = P_c / T$$

The above shows that if the duration time T is sufficiently shortened, $I_c$ can be sufficiently large.

What is claimed is:

1. A stabilizer apparatus comprising:

a continuous running body arranged in a continuous loop;

a guide means for supporting said continuous running body and for guiding said continuous running body along a closed loop path;

means for continuously driving said continuous running body around said path; and track shifting means for moving at least a portion of said guide means, thereby changing the geometric configuration of said path and angular momentum of said continuous running body.

2. A stabilizer according to claim 1: wherein the path of said continuous loop crosses at a crossover point to divide said continuous loop into a clockwise section of area $S_1$ wherein said continuous running body runs in a clockwise direction and a counter-clockwise section of area $S_2$ wherein said continuous running body runs in a counter-clockwise direction, with the angular momentum of the continuous running body in one of said sections at least partially offsetting its angular momentum in the other of said sections to produce a net angular momentum; and wherein said movement of said guide means by said track shifting means changes the location of said crossover point, changes the ratio of $S_1$ to $S_2$ and changes the net angular momentum.

3. A stabilizer according to claim 1 wherein said guide means comprises at least one guide rail and wherein a portion of said guide rail is movable by said track shifting means.

4. A stabilizer according to claim 1 for application to a floating structure and further comprising:

sensing means for sensing at least one of the angle, angular velocity and angular acceleration of rolling of the floating structure and for generating a sensor signal;

a processor for generating a control signal in accordance with said sensor signal; and a servo motor for driving said track shifting means responsive to said control signal.

5. A stabilizer according to claim 4 wherein the floating structure is a floating platform.

6. A stabilizer according to claim 4 wherein said guide means comprises a first plurality of pulleys fixed to the floating structure, a second plurality of pulleys coplanar with said first plurality of pulleys and movably mounted for movement, relative to said first plurality of pulleys, by said track shifting means.

7. A stabilizer according to claim 4 wherein track shifting means is responsive to rolling of the floating structure thereby providing passive stabilization of the floating structure.

8. A stabilizer according to claim 1 wherein said continuous running body comprises at least one endless belt.

9. A stabilizer according to claim 1 wherein said continuous running body comprises at least one endless chain.

10. A stabilizer according to claim 1 wherein said continuous running body comprises a plurality of discrete, separated bodies.

* * * * *

UNITED STATES PATENT AND TRADEMARK OFFICE

CERTIFICATE OF CORRECTION

PATENT NO. : 5,379,713
DATED : January 10, 1995
INVENTOR(S) : FUJIMURA et al

It is certified that error appears in the above-indentified patent and that said Letters Patent is hereby corrected as shown below:

Col. 1, line 36, after "present" insert --invention--.

Col. 2, line 25, "Other" should read --other--.

Col. 3, line 42, "rack" should read --track--.

Col. 9, line 60, "$V_d$" should read --$V_b$--.

Col. 10, line 29, "$(M_a 33 V_o)$" should read --$(M_a x V_o)$--.

Signed and Sealed this

Twenty-fourth Day of October, 1995

*Attest:*

BRUCE LEHMAN

*Attesting Officer*

*Commissioner of Patents and Trademarks*